United States Patent [19]

Bourne

[11] 4,191,531

[45] Mar. 4, 1980

[54] DISCHARGE CHUTE ASSEMBLY FOR CALCINING HEARTH

[75] Inventor: Percy V. Bourne, Scarborough, Canada

[73] Assignee: Calcimatic International Limited, Grand Cayman, Cayman Islands

[21] Appl. No.: 893,893

[22] Filed: Apr. 6, 1978

[51] Int. Cl.[2] ..... F27D 3/00

[52] U.S. Cl. ..... 432/239; 414/212; 414/149

[58] Field of Search ..... 432/124, 239; 423/177; 214/18 R, 21, 22

[56] References Cited

U.S. PATENT DOCUMENTS 3,345,052 10/1967 Hall ..... 432/1 X 3,998,703 12/1976 Harrell ..... 432/124

*Primary Examiner*—John J. Camby

*Attorney, Agent, or Firm*—Shenier & O'Connor

[57] ABSTRACT

A discharge chute assembly for a rotary calcining hearth in which a carriage movable radially along tracks carries one or more pairs of opposed rollers receiving a flange extending around the hearth. The carriage supports the chute to cause the chute to follow any radial fluctuations in the position of the hearth edge and thereby minimize spillage of material. The chute is disposed with its upper edge extending into an outwardly opening circumferential channel formed around the side of the hearth beneath the upper surface, further minimizing spillage.

6 Claims, 4 Drawing Figures

DISCHARGE CHUTE ASSEMBLY FOR CALCINING HEARTH

BACKGROUND OF THE INVENTION

My invention relates to a discharge chute assembly for a moving hearth and, in particular, to an assembly for use with the rotary hearth of a calcining kiln.

As is known in the prior art, limestone, which is largely calcium carbonate, is reduced to lime or calcium oxide by subjecting the limestone to a high heat for a predetermined period of time. In one method of calcining, shown for example in U.S. Pat. No. 3,345,052, issued to H. L. Hall, the limestone is deposited in the form of small pellets on the surface of an annular hearth which is rotated continuously on a vertical axis to carry the pellets through successive heating zones of an annular kiln. When the pellets have been converted to lime and have moved to a certain point along the circular course, a belt or the like with vanes or pushers sweeps the pellets outwardly onto a stationary chute down which the lime slides into a hopper or the like.

One of the problems associated with hearth assemblies of the prior art relates to the transfer of the calcined pellets from the surface of the rotating hearth to the stationary chute. Because the hearth is composed of refractory materials and typically has a large diameter of ninety feet, for example, eccentricities develop along the outer periphery of the hearth, causing a periodic fluctuation in the displacement between the hearth periphery and the discharge chute. Imperfections in the circular tracks used to support the hearth may cause additional fluctuations in displacement. As a result, placing the chute sufficiently far from the hearth to provide adequate clearance results in substantial spillage of pellets in the gap between the hearth and the discharge chute, wasting material and possibly interfering with the mechanical operation of the hearth. Discharge chutes of the prior art also have the problem of "hanging up" of the pellets along the length of the chute.

SUMMARY OF THE INVENTION

One of the objects of my invention is to provide a discharge chute assembly for a rotating hearth which minimizes spillage of material.

Another object of my invention is to provide a discharge chute assembly providing an adequate clearance from a rotating hearth.

Still another object of my invention is to provide a discharge chute assembly which minimizes the chance for material to hang up along the chute.

Other and further objects of my invention will be apparent from the following description.

In general, my invention contemplates a discharge chute assembly in which a first subassembly supports the chute for free radial movement relative to the hearth axis while fixing the chute circumferentially, while a second subassembly fixes the radial position of the chute relative to the hearth while permitting free circumferential movement of the hearth. Preferably the first subassembly comprises a carriage supporting the chute and movable radially along tracks, while the second subassembly comprises one or more pairs of rollers supported by the carriage which engage a flange carried by the hearth. The combined action of the two subassemblies is thus to locate the discharge chute a fixed distance radially from the irregular periphery of the hearth while also fixing the position of the chute circumferentially. As a result, only a very small clearance need be provided between the periphery of the hearth and the discharge chute, substantially reducing spillage.

In another aspect, my invention contemplates the provision of an outwardly opening circumferential channel around the side of the hearth just beneath the upper surface. I dispose the chute with its upper edge extending into the channel, effectively eliminating the gap between the chute and the hearth and further reducing spillage. The disposition of the upper end of the chute somewhat below the upper material-bearing surface of the hearth also minimizes the problem of hang-ups along the chute by ensuring that the pellets collected by the chute have already acquired some downward momentum.

BRIEF DESCRIPTION OF THE DRAWINGS

In the accompanying drawings which form part of the instant specification and which are to be read in conjunction therewith and in which like reference numerals are used to indicate like parts in the various views.

DETAILED DESCRIPTION OF THE PREFERRED EMBODIMENT

Figure 1:
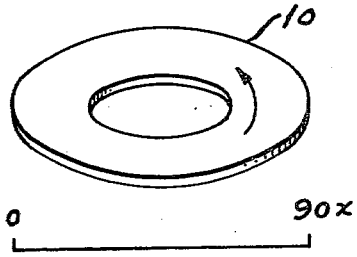
FIG. 1 is a simplified perspective view of the hearth with which my invention is used.

Referring to the drawings, my apparatus is used in conjunction with an annular refractory hearth 10 arranged on a vertical axis and rotated in the direction shown in FIG. 1. Limestone pellets 14 supplied to the upper surface 12 of the hearth 10 are carried by the movement of the hearth through an annular kiln (not shown) where the pellets are heated to form lime. A detailed description of the kiln and the means for rotating the hearth 10 may be found in U.S. Pat. Nos. 3,050,298 and 3,345,052, issued to H. L. Hall, hereby incorporated by reference. Continued rotation of the hearth 10 carries the pellets 14 to a removal station at which outwardly extending vanes or pushers 16 of a belt 18 sweep the pellets outwardly to fall down a chute 24 into a collecting hopper 26.

I provide the chute 24 with a support assembly, indicated generally by the reference character 28, which maintains the chute 24 in constant radial relationship with a downwardly extending skirt or flange 22 running along the outer periphery of the hearth 10. Assembly 28 includes a pair of circumferentially spaced I-beams 32, which rest on bases 30 of mortar or the like. I employ shims 34 accurately to locate a pair of radially spaced lower brackets 36 on beams 38.

Rollers 40 carried by the lower brackets 36 support a rectangular carriage, indicated generally by reference character 42, for radial movement toward and away from the hearth 10. Carriage 42 comprises a pair of channels 44 joined by respective inner and outer channels 46 and 48. The outwardly extending lower portions of channels 44 are received by the rollers 40. Respective retainers 38 secured to the lower brackets 36 extend over the lower flanges of the channels of frame 44 to prevent possible derailment. Each of the channels 44 carries a pair of spaced brackets 52 which support respective rollers 50 on opposite sides of the flange 22 in rolling relation therewith.

It will be apparent from the above description that rollers 50 maintain the carriage 42 in constant radial relationship with the flange 22 of the hearth 10. At the same time rollers 40 allow the carriage 42 to roll radially while confining it circumferentially. The combined effect of rollers 50 and 40 is thus to locate the carriage 42 at a position which is constant circumferentially but radially dependent on the position of the edge of the hearth 10.

I employ any suitable means such as welding or the like to secure the upper ends of a pair of vertically disposed angle irons 54 to the underside of chute 24. I adjustably secure the lower ends of the angle irons 54 to the carriage 42. More specifically, I form the angle irons 54 with respective vertically extending elongated slots 56 adjacent to the lower ends thereof. I form member 48 with respective bolt-receiving holes 58 in alignment with slots 56. In addition, respective vertically elongated slots 60 in angle irons 54 intersect horizontally elongated slots 62 in channel irons 44. Adjustable bolts 66 received by nuts 68 fixedly secured to the channels 44 abut against stops 64 on the angle irons 54 to provide an adjustable vertical support for the chute 24. I so adjust the height and radial position of the chute 24 that a lip 25 at the upper inboard edge thereof extends into an outwardly opening indentation or channel 20 running along the periphery of the hearth 10, further reducing if not eliminating the amount of material 14 spilled during transfer. Bolts (now shown) passing through slot-and-hole pairs 56 and 58 and through slot pairs 60 and 62 hold the assembly in its adjusted position.

Figure 2:
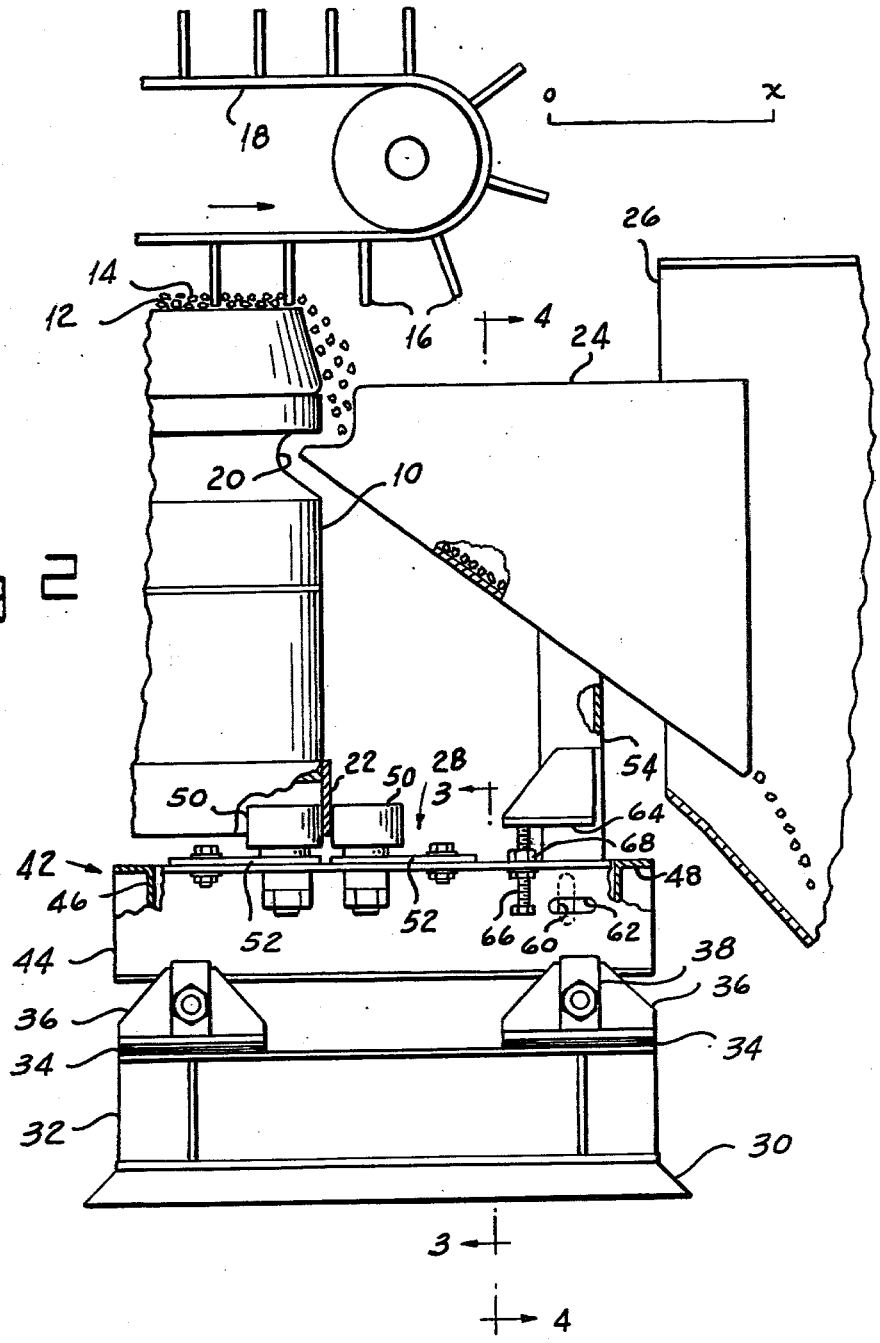
FIG. 2 is a side elevation of my discharge chute assembly with parts broken away and with other parts shown in section as used with the hearth shown in FIG. 1.
Figure 3:
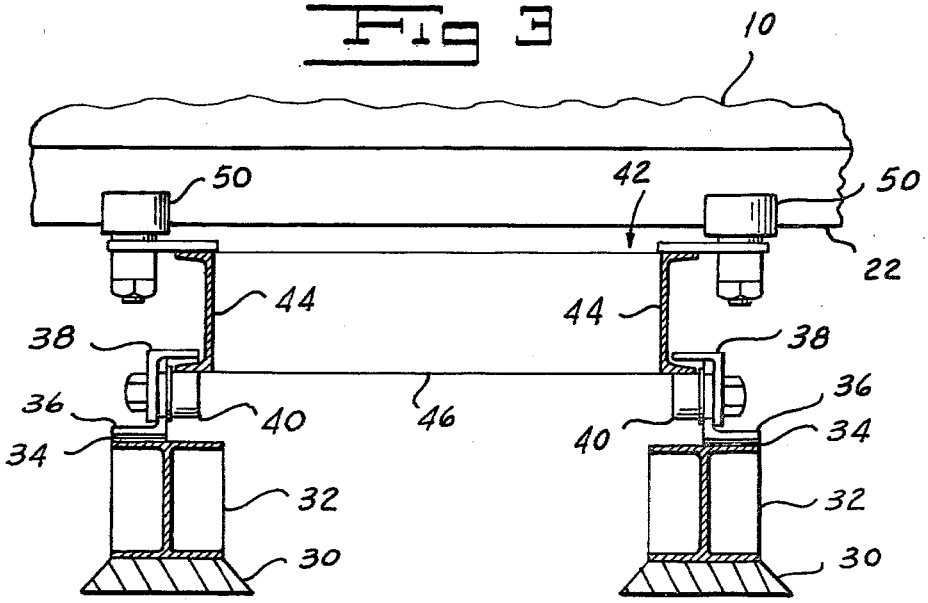
FIG. 3 is a section of the assembly shown in FIG. 2, taken along line 3—3 thereof.
Figure 4:
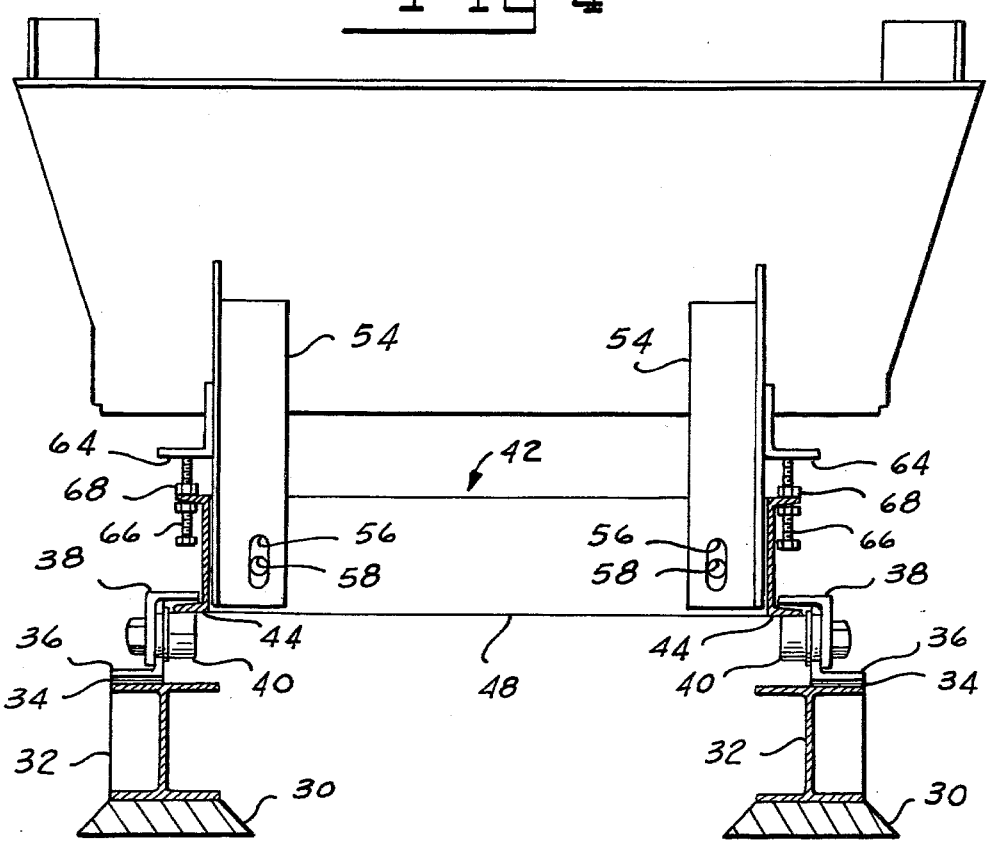
FIG. 4 is a section of the assembly shown in FIG. 2, taken along line 4—4 thereof.

As has been pointed out hereinabove, in a practical installation the hearth 10 is of a relatively large diameter as compared with the distance through which the lime must be moved from the hearth to the discharge chute while at the same time avoiding spillage. By way of example, in FIG. 2, I have indicated a scale of a distance x in the radial direction with reference to the hearth as indicating some measure of the relative dimensions involved. At the same time, as indicated in FIG. 1, the overall diameter of the hearth may be 90x. If, for example, x is one foot the hearth would be ninety feet in diameter. As is known in the prior art, in the course of the calcining operation the hearth carries the stone being converted through various zones in which the stone and the hearth thereunder are subjected to very high temperatures. It will readily be appreciated that, as a result of the range of temperatures through which the hearth is cycled in the course of repeated or continuous operations, distortion of the material of the hearth results after a period of time. Moreover, a relatively small distortion per unit length will produce a relatively great overall change at the periphery of the hearth. It has been discovered, furthermore, that the distortion is not uniform around the periphery of the hearth.

In operation of my discharge chute assembly, as the hearth rotates the discharge chute 24 automatically moves inwardly and outwardly to accommodate the irregularities. In this manner, spillage of the lime as it moves into chute 24 is is minimized. The cooperation of the lip of the chute 24 with the circumferential groove 20 further reduces spillage. The location of the mouth of the chute at an appreciable distance below the upper surface of the hearth ensures that the material moving off the hearth has some downward velocity before it enters the chute so that the danger of the material hanging up in the chute and building up therein is reduced.

It will be seen that I have accomplished the objects of my invention. My discharge chute assembly minimizes the spillage of material being transferred from the hearth while at the same time providing adequate clearance between the chute and the hearth. My assembly also minimizes the chance for material to hang up along the chute.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In an apparatus including a circular hearth for supporting material to be treated, means for rotating said hearth to carry said material through a treatment zone to a discharge station, and a discharge chute having a lip at said discharge station for receiving treated material discharged from said hearth, the improvement comprising means forming a recess below the surface of said hearth, a stationary frame at said discharge station, a carriage, rolling means for supporting said carriage on said frame for radial movement with respect to said hearth, adjustable means mounting said chute on said carriage, said adjustable means permitting vertical and radial adjustment of the position of said chute on said carriage to locate said lip in said recess, a peripheral flange on said hearth having inner and outer sides, and respective rollers on said carriage engaging said sides of said flange for maintaining a relatively constant radial position of said chute relative to the portion of said hearth at said discharge station.

2. In an apparatus including a circular hearth for supporting material to be treated, means for rotating said hearth to carry said material through a treatment zone to a discharge station, and a member at said discharge station for receiving treated material discharged from said hearth, the improvement comprising means for supporting said receiving member for radial movement with relation to said hearth, a peripheral flange on said hearth having inner and outer sides, and rollers on said carriage engaging said sides of said flange to maintain a generally constant radial position of said chute relative to the portion of said hearth at said discharge station.

3. In an apparatus including a circular hearth for supporting material to be treated, means for rotating said hearth to carry said material through a treatment zone to a discharge station, and a member at said discharge station for receiving treated material discharged from said hearth, the improvement comprising means for supporting said receiving member for radial movement relative to said hearth and interengageable means on said hearth and on said chute for maintaining a generally constant radial position of said chute relative to the position of said hearth at said discharge station.

4. In an apparatus including a circular hearth for supporting material to be treated, means for rotating said hearth to carry said material through a treatment zone to a discharge station, and a member at said discharge station for receiving treated material discharged from said hearth, the improvement comprising means for supporting said receiving member for radial movement with relation to said hearth and means for maintaining a relatively constant radial position of said member relative to the portion of said hearth at said discharge station.

5. In an apparatus including a circular hearth for supporting material to be treated, means for rotating said hearth to carry said material through a treatment zone to a discharge station, and a chute having a lip at said discharge station for receiving treated material discharged from said hearth, the improvement comprising means for supporting said chute for radial movement relative to said hearth, means for maintaining a relatively constant radial position of said chute relative to the portion of said hearth at said discharge station, a peripheral recess on said hearth below the material-supporting surface thereof, and means mounting said chute on said supporting means with said lip disposed in said recess.

6. In an apparatus including a circular hearth for supporting material to be treated, means for rotating said hearth to carry said material through a treatment zone to a discharge station, and a chute having a lip at said discharge station for receiving treated material discharged from said hearth, the improvement comprising a peripheral recess in said hearth below the material-supporting surface thereof and means mounting said chute at said discharge station with said lip disposed in said recess.

* * * * *